US006980155B2

(12) United States Patent
Lee et al.

(10) Patent No.: US 6,980,155 B2
(45) Date of Patent: Dec. 27, 2005

(54) INTERNAL DIVERSITY ANTENNA

(75) Inventors: Jae Chan Lee, Kyungki-do (KR); Hee Chan Park, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 27 days.

(21) Appl. No.: 10/722,543

(22) Filed: Nov. 28, 2003

(65) Prior Publication Data

US 2005/0062656 A1 Mar. 24, 2005

(30) Foreign Application Priority Data

Sep. 19, 2003 (KR) ..... 10-2003-0065015

(51) Int. Cl.[7] ..... H01Q 1/38
(52) U.S. Cl. ..... 343/700 MS; 343/702
(58) Field of Search ..... 343/700 MS, 702, 343/846, 848

(56) References Cited

U.S. PATENT DOCUMENTS 6,061,024 A * 5/2000 McGirr et al. ..... 343/700 MS
6,339,402 B1 * 1/2002 McKivergan ..... 343/702
6,456,243 B1 * 9/2002 Poilasne et al. ..... 343/700 MS
6,570,538 B2 * 5/2003 Vaisanen et al. ..... 343/702
6,675,461 B1 * 1/2004 Rowson et al. ..... 29/600
6,795,028 B2 * 9/2004 Stutzman et al. ..... 343/702

* cited by examiner

*Primary Examiner*—Tan Ho
(74) *Attorney, Agent, or Firm*—Lowe Hauptman & Berner, LLP

(57) ABSTRACT

A diversity antenna is provided inside a mobile communication terminal. A common ground element formed as a conductor having predetermined length grounds the antenna. A first radiating element radiates a vertically polarized wave of a predetermined band. One end of the first radiating element is vertically connected to one end of the commnon ground element and the other end of the first radiating element is open. A second radiating element radiates a horizontally polarized wave of the predetermined band. One end of the second radiating element is vertically connected to the other end of the common ground element and the other end of the second radiating element is open. First and second feeding elements feed electric current to the radiating elements.

10 Claims, 7 Drawing Sheets

INTERNAL DIVERSITY ANTENNA

BACKGROUND OF THE INVENTION

1. Field of the Invention

The present invention relates to an antenna of a mobile communication terminal, and more particularly to a diversity antenna provided inside a mobile communication terminal for preventing the degradation of transmission quality due to fading effects.

2. Description of the Related Art

As mobile communication terminals are miniaturized and decreased in weight, various service functions need to be provided. There is a trend that internal circuits and components adopted in the mobile communication terminals are multi-functioned and also are constantly miniaturized, in order to satisfy the need for the various service functions. Similarly, This trend of the miniaturization and weight reduction are also needed in an antenna, one of the major component of the mobile communication terminals.

Conventionally, a planar inverted F antenna (PIFA) having a low profile structure is employed as an internal antenna configured inside a mobile communication terminal. FIG. 1 is a perspective view illustrating a structure of the conventional PIFA. The conventional PIFA includes a radiating element 2, a shorting pin 4, a coaxial wire 5 and a ground plate 9. The radiating element 2 is fed through the coaxial wire 5, and is connected to the ground plate 9 by the shorting pin 4 so that an impedance match can be achieved. The conventional PIFA must be designed by taking into account the length L of the radiating element 2 and the height H of the antenna according to the width $W_p$ of the shorting pin 4 and the width W of the radiating element 2.

In this PIFA, among beams generated by the induced current to the radiating unit 2, beams directed toward a ground plane are re-induced, thereby reducing the beams directed toward the human body and improving the SAR characteristic. Further, the beams induced toward the radiating unit 2 are increased. This PIFA functions as a square-shaped micro-strip antenna with the length of the radiating unit 2 reduced to half, achieving a low profile structure. Further the PIFA is an internal antenna installed in the mobile communication terminal, thereby being aesthetically designed and protected from external impact.

This PIFA is constantly improved according to a trend of multi-functioning. In particular, a multipath phenomenon can be caused by radio waves reflected from buildings or geographical features in a mobile communication environment. A fading phenomenon in which the amplitude of a received signal varies can be caused by the multipath phenomenon. To reduce this fading phenomenon and achieve desired transmission quality, a diversity antenna consisting of a plurality of antennas is employed.

FIG. 2 is a plane view illustrating the structure of a conventional internal diversity antenna.

Referring to FIG. 2, the conventional internal diversity antenna includes an array of antennas 220 and 221 arranged on a substrate 210. The antennas 220 and 221 are separated from each other. A feeding element (not shown) is formed at one end of each antenna 220 or 221. When power supply voltage is applied to the feeding element, the radio wave of a desired frequency band is radiated through the antenna 220 or 221. However, there is a problem in that a wide space is needed since the above-described conventional antenna array needs a sufficient separation distance between the antennas. Since the antennas 220 and 221 are arranged on the same horizontal plane provided in the conventional diversity antenna and radio waves radiated from the antennas 220 and 221 are directed in the same direction, a mutual complement on a radiation pattern cannot be achieved. Thus, there is a drawback in that the conventional internal diversity antenna cannot provide desired transmission quality.

SUMMARY OF THE INVENTION

Therefore, the present invention has been made in view of the above problems, and it is one object of the present invention to provide an internal antenna, which can provide a diversity function using a narrow space occupied within a mobile terminal, and improve the efficiency of reception of an overall antenna.

It is another object of the present invention to provide an internal antenna, which can reduce mutual interference effects between radiation signals by separately configuring radiating elements responsible for radiating a horizontally polarized wave and a vertically polarized wave within a mobile terminal.

In accordance with one aspect of the present invention, the above and other objects can be accomplished by the provision of an internal diversity antenna, comprising: a common ground element formed as a conductor having predetermined length for grounding an antenna; a first radiating element for radiating a vertically polarized wave of a predetermined band according to a ground condition of the antenna, wherein one end of the first radiating element is vertically connected to one end of the common ground element and the other end of the first radiating element is open; a first feeding element connected to the first radiating element for feeding electric current to the first radiating element; a second radiating element for radiating a horizontally polarized wave of the predetermined band according to a ground condition of the antenna, wherein one end of the second radiating element is vertically connected to the other end of the common ground element and the other end of the second radiating element is open; and a second feeding element connected to the second radiating element for feeding electric current to the second radiating element.

Preferably, the first feeding element may be vertically connected to the first radiating element.

Preferably, the second feeding element may be vertically connected to the second radiating element.

Preferably, the first or second radiating element may be a wire radiating element.

Preferably, the first or second radiating element may be a planar radiating element.

Preferably, the first feeding element and the second feeding element may be arranged vertically to each other.

In accordance with another aspect of the present invention, there is provided an internal diversity antenna, comprising: a first radiating element for radiating a vertically polarized wave of a predetermined band according to a ground condition of the antenna; a first feeding element connected to the first radiating element for feeding electric current to the first radiating element; a second radiating element for radiating a horizontally polarized wave of the predetermined band according to the ground condition of the antenna; a second feeding element connected to the second radiating element for feeding electric current to the second radiating element; and a common ground element for forming a ground with electromagnetic coupling between the first radiating element and the second radiating element, and grounding the first and second radiating elements, wherein part of the first radiating element is vertically separated from part of the second radiating element by a predetermined distance (W2), the parts of first and second radiating elements overlapping each other, and the first or second radiating element is a planar radiating element.

In accordance with yet another aspect of the present invention, there is provided an internal diversity antenna, comprising: a first radiating element for radiating a vertically polarized wave of a predetermined band according to a ground condition of the antenna; a second radiating element connected to one end of the first radiating element for radiating a horizontally polarized wave of the predetermined band according to the ground condition of the antenna; a first feeding element for feeding electric current to the first radiating element, wherein the first feeding element is connected to a connection part to which the first and second radiating elements are connected; a second feeding element vertically connected to the first radiating element at the connection part for feeding electric current to the second radiating element; and a common ground element vertically connected to the first and second radiating elements at the connection part for grounding the antenna.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
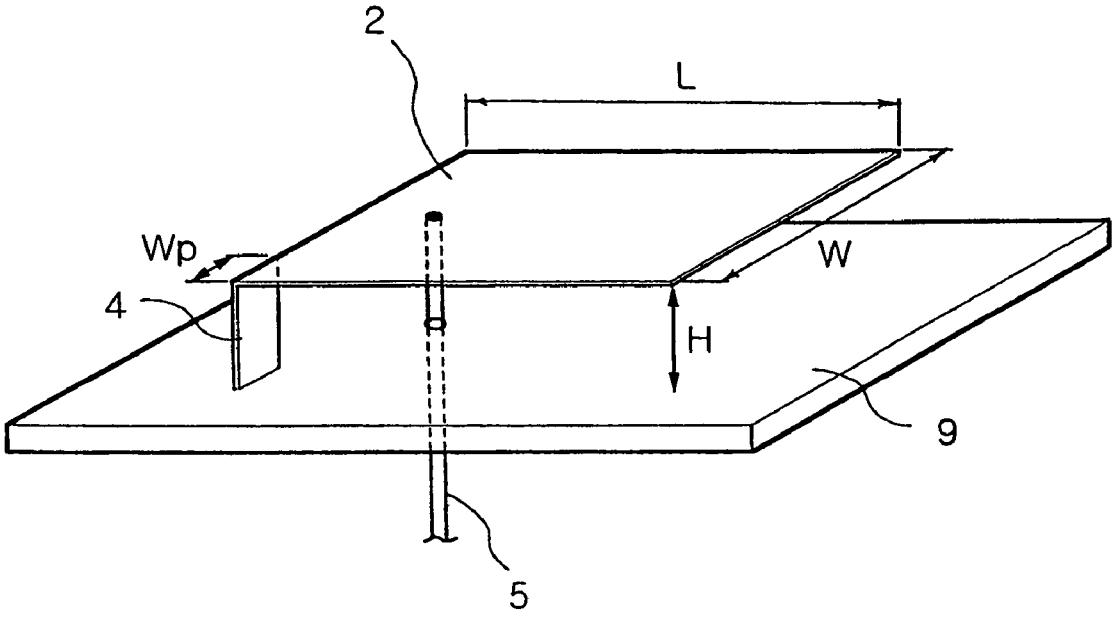
PRIOR ART FIG. 1
FIG. 1 is a perspective view illustrating the structure of a conventional planar inverted F antenna (PIFA)
Figure 2:
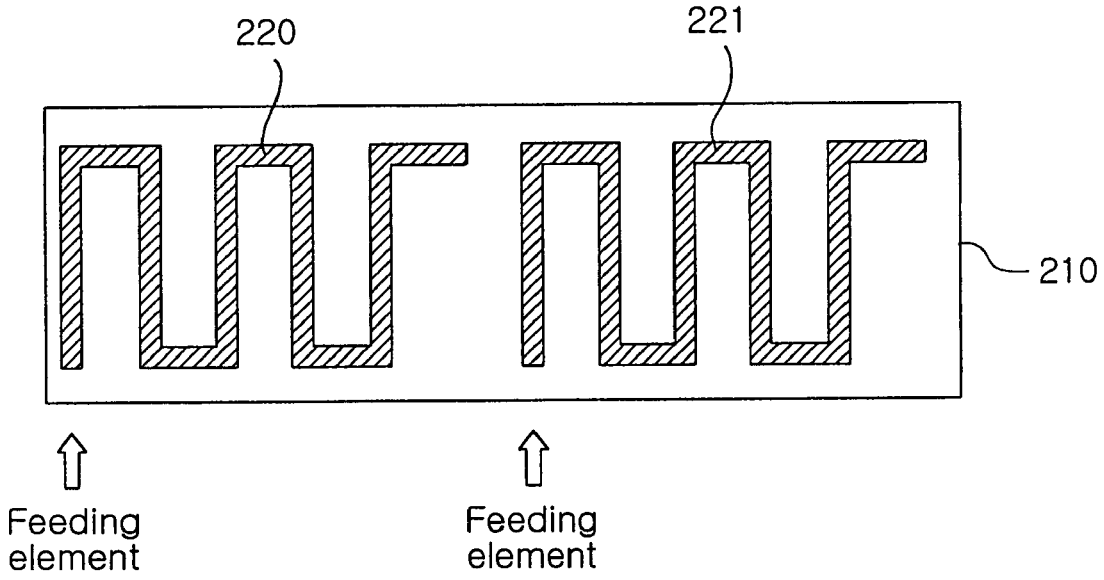
PRIOR ART FIG. 2
FIG. 2 is a plane view illustrating the structure of a conventional internal diversity antenna.

Now, preferred embodiments of the present invention will be described in detail with reference to the annexed drawings. In the drawings, the same or similar elements are denoted by the same reference numerals even though they are depicted in different drawings. In the following description, a detailed description of known functions and configurations incorporated herein will be omitted when it may make the subject matter of the present invention rather unclear.

Figure 3:
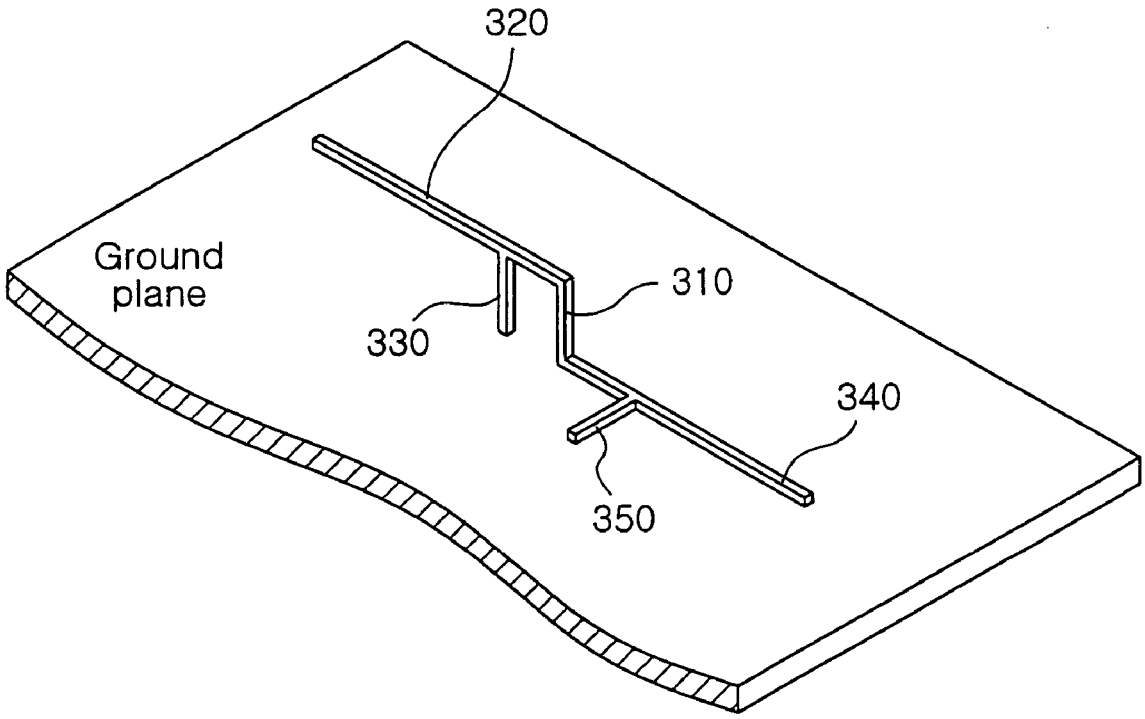
FIG. 3 is a perspective view illustrating the structure of an internal diversity antenna in accordance with the first embodiment of the present invention.

FIG. 3 is a perspective view illustrating the structure of an internal diversity antenna in accordance with the first embodiment of the present invention.

Referring to FIG. 3, the internal diversity antenna in accordance with the first embodiment of the present invention includes a common ground element 310, a first radiating element 320, a first feeding element 330, a second radiating element 340 and a second feeding element 350.

First, the common ground element 310 is formed by a conductor having predetermined length. One end of the first radiating element 320 is vertically connected to one end of the common ground element 310, and the other end of the first radiating element 320 is open. Furthermore, the first feeding element 330 is vertically connected to the first radiating element 320 at a predetermined location adjacent to the common ground element 310 of the first radiating element 320. If the first feeding element 330 is connected to an external circuit and receives incoming electric current according to the above-described structure, the first radiating element 320 is configured so that the radio wave of a predetermined band can be radiated. In particular, the first radiating element 320 radiates a vertically polarized wave of the predetermined band according to a ground condition of the antenna. The common ground element 310 grounds the first radiating element 320.

One end of the second radiating element 340 is connected to the other end of the common ground element 310. The second feeding element 350 is vertically connected to the second radiating element 340 at a predetermined location adjacent to the common ground element 310 of the second radiating element 340. If the second feeding element 350 is connected to an external circuit and receives incoming electric current, the second radiating element 340 is configured so that the radio wave of the predetermined band can be radiated. In particular, the second radiating element 340 radiates a horizontally polarized wave of the predetermined band according to a ground condition of the antenna. The common ground element 310 grounds the second radiating element 340.

As the first radiating element 320 for vertically polarized wave and the second radiating element 340 for horizontally polarized wave as described above are respectively formed, a polarization diversity function can be provided. Furthermore, as the first and second radiating elements 320 and 340 are connected to the common ground element 310, a compact internal antenna can be manufactured. Preferably, the first feeding element 330 and the second feeding element 350 are arranged vertically to each other. However, when a ground condition based on the structure of the terminal equipped with the internal antenna is varied, an angle between the first feeding element 330 and the second feeding element 350 can be varied so that the first radiating element 320 and the second radiating element 340 radiate the vertically and horizontally polarized waves of a predetermined band frequency, respectively. Furthermore, the radiating element can be a wire or planar radiating element, and can be variously modified.

Figure 3A:
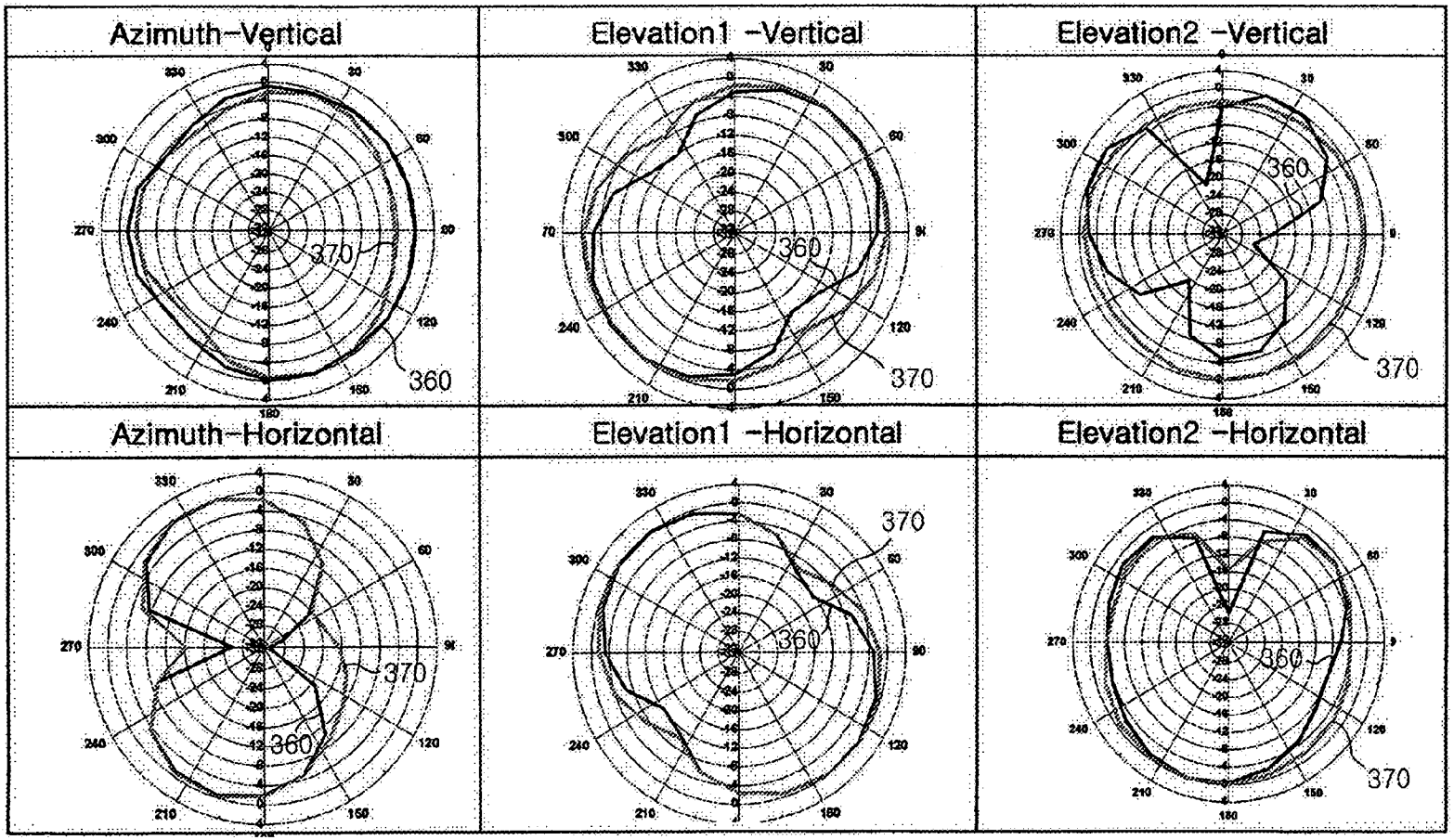
FIG. 3A is a view illustrating diversity effects of the internal diversity antenna in accordance with the first embodiment of the present invention.

FIG. 3A is a view illustrating diversity effects of the internal diversity antenna in accordance with the first embodiment of the present invention.

Referring to FIG. 3A, there are shown a radiation pattern 360 of the conventional internal diversity antenna using one radiating element and a radiation pattern 370 of the inventive diversity antenna in accordance with the embodiment of the present invention. FIG. 3A shows vertical radiation patterns and horizontal radiation patterns in conditions of azimuths, elevations 1 and elevations 2. As shown in FIG. 3A, the radiation pattern 370 of the inventive diversity antenna in accordance with the embodiment of the present invention has the considerably improved efficiency of reception in comparison with the conventional radiating pattern 360.

Figure 4:
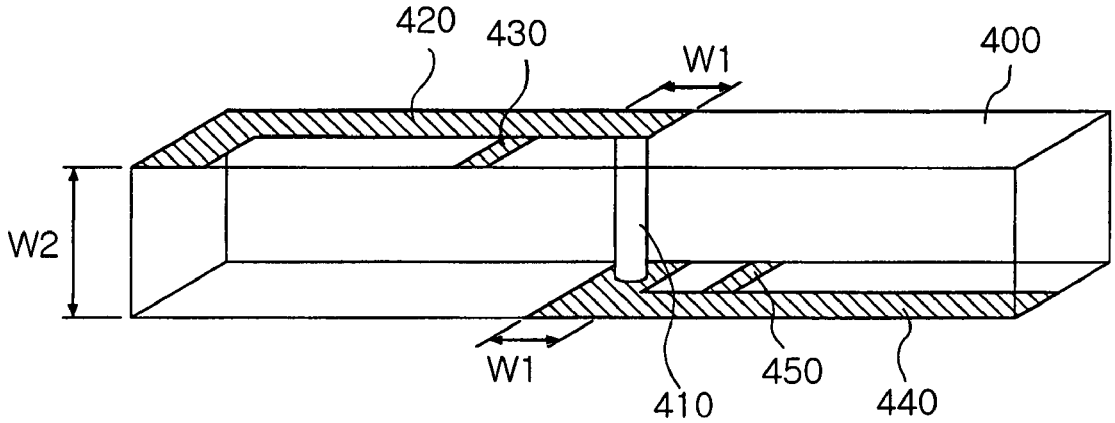
FIG. 4 is a schematic perspective view illustrating the structure of an internal diversity antenna in accordance with the second embodiment of the present invention.

FIG. 4 is a schematic perspective view illustrating the structure of an internal diversity antenna in accordance with the second embodiment of the present invention.

Referring to FIG. 4, the internal diversity antenna in accordance with the second embodiment of the present invention is similar to the internal diversity antenna in accordance with the first embodiment of the present invention in that the internal diversity antenna shown in FIG. 4 includes a first radiating element 420 for radiating a vertically polarized wave of a desired predetermined band, a second radiating element 440 for radiating a horizontally polarized wave of the predetermined band, and feeding elements 430 and 450 for the first and second radiating elements 420 and 440.

The antenna in accordance with the second embodiment of the present invention includes the first and second radiating elements 420 and 440 serving as a planar antenna. Further, a common ground element 410 is formed by a conductor having predetermined length. Furthermore, one end of the common ground element 410 is vertically connected to one end of the first radiating element 420, and similarly, the other end of the common ground element 410 is vertically connected to one end of the second radiating element 440. Here, the first feeding element 430 is vertically connected to the common ground element 410 at a predetermined location adjacent to the common ground element 410 of the first radiating element 420. When electric current is fed to the first feeding element 430 in the above-described structure, the first radiating element 420 is configured so that a vertically polarized wave of a desired predetermined band can be radiated. The second feeding element 450 is adjacent to the common ground element 410 of the second radiating element 440, and is vertically connected to the common ground element 410 at a predetermined location that is diagonally symmetrical to the first feeding element 430. When electric current is fed to the second feeding element 450 in the above-described structure, the second radiating element 440 is configured so that a horizontally polarized wave of the predetermined band can be radiated. Furthermore, the radiating elements 420 and 440 and the feeding elements 430 and 450 are fixed by a dielectric supporter 400.

Figure 5:
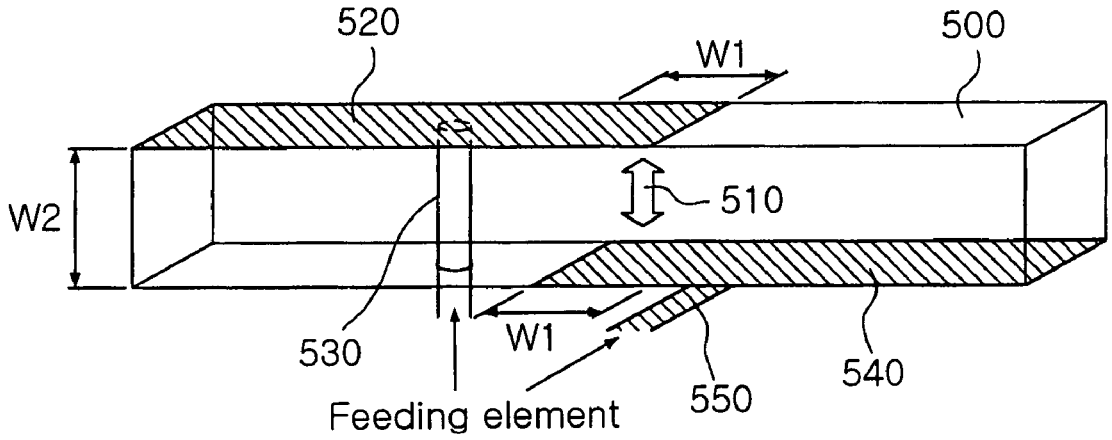
FIG. 5 is a schematic perspective view illustrating the structure of an internal diversity antenna in accordance with the third embodiment of the present invention.

FIG. 5 is a schematic perspective view illustrating the structure of an internal diversity antenna in accordance with the third embodiment of the present invention.

Referring to FIG. 5, the internal diversity antenna in accordance with the third embodiment of the present invention includes a first radiating element 520 and a second radiating element 540 serving as a planar antenna. Part of the first radiating element 520 (e.g., part of the first radiating element 520 having the length W1) is vertically separated from part of the second radiating element 540 (e.g., part of the second radiating element 540 having the length W1) by a predetermined distance W2 and the first and second radiating elements 520 and 540 are arranged so that they overlap each other. In the above-described structure, the ground is formed by electromagnetic coupling between the first radiating element 520 and the second radiating element 540. In other words, the common ground element 510 between the first radiating element 520 and the second radiating element 540 is not formed by an additional conductor, and one end of the first radiating element 520 and one end of the second radiating element 540 are separated by a predetermined distance W2, and are arranged on the same vertical plane, such that the common ground element 510 is formed.

Here, a first feeding element 530 is horizontally connected to the first radiating element 520 at a predetermined location adjacent to the common ground element 510 in a parallel direction with the common ground element 520. Furthermore, the second feeding element 550 is vertically connected to the second radiating element 540 at a predetermined location adjacent to the common ground element 510 in a vertical direction to the common ground element 520. As described in relation to other embodiments, the first radiating element 520 radiates a vertically polarized wave, and the second radiating element 540 radiates a horizontally polarized wave. Furthermore, the radiating elements 520 and 540 and the feeding elements 530 and 550 are fixed by a dielectric supporter 500.

Figure 6:
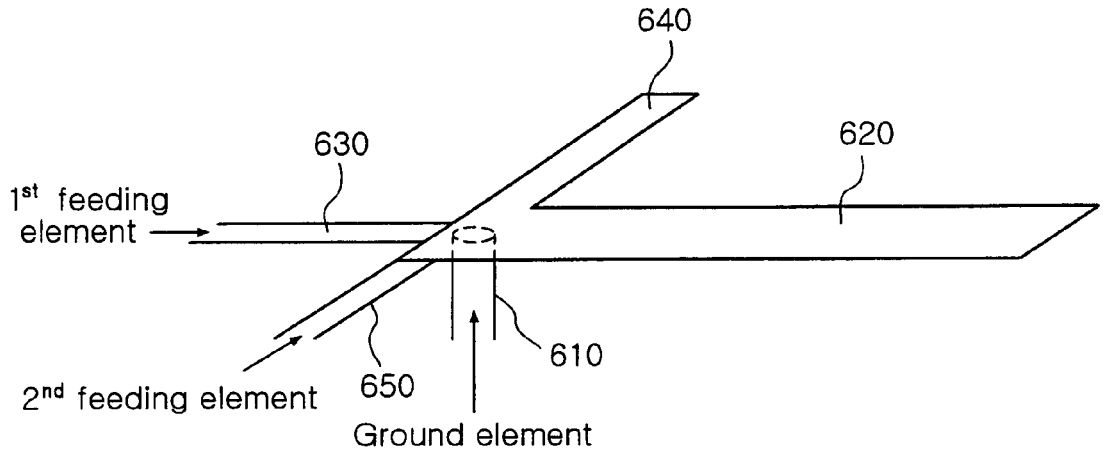
FIG. 6 is a schematic perspective view illustrating the structure of an internal diversity antenna in accordance with the fourth embodiment of the present invention.

FIG. 6 is a schematic perspective view illustrating the structure of an internal diversity antenna in accordance with the fourth embodiment of the present invention.

Referring to FIG. 6, one end of a first radiating element 620 and one end of a second radiating element 640 are vertically connected to each other on the same horizontal plane. Furthermore, a first feeding element 630, a second feeding element 650 and a common ground element 610 are orthogonally connected at an edge to which the first radiating element 620 and the second radiating element 640 are connected. For example, the first feeding element 630 is connected in a lengthwise direction of the first radiating element 620 at the edge, the second feeding element 650 is connected in a lengthwise direction of the second radiating element 640 at the edge, and the common ground element 610 at the edge is orthogonally connected to a horizontal plane on which the first radiating element 620 and the second radiating element 640 are formed. Locations of the first feeding element 630, the second feeding element 650 and the common ground element 610 can be exchanged with one another. Furthermore, if the first feeding element 630, the second feeding element 650 and the common ground element 610 are orthogonally connected to one another even though a shape of each radiating element is changed, a diversity antenna in accordance with the present invention can be implemented.

As apparent from the above description, the present invention can improve the efficiency of reception of an overall antenna by providing a diversity function to an internal antenna.

Further, the present invention can reduce mutual interference effects between radiation signals by separate forming of radiating elements which radiates a horizontally polarized wave and a vertically polarized wave respectively.

Further, the present invention can implement the miniaturization of a mobile terminal by providing a diversity antenna in a narrow space occupied within an internal antenna.

Furthermore, the present invention can reduce the cost of an antenna and a mobile terminal equipped with the antenna by implementing a diversity function using a single antenna rather than a plurality of antennas.

The preferred embodiments of the present invention have been disclosed for illustrative purposes. Those skilled in the art will appreciate that various modifications, additions and substitutions are possible, without departing from the scope and spirit of the invention as disclosed in the accompanying claims.

What is claimed is:

1. An internal diversity antenna, comprising:

a common ground element formed as a conductor having predetermined length for grounding the antenna;

a first radiating element for radiating a vertically polarized wave of a predetermined band according to a ground condition of the antenna, wherein one end of the first radiating element is perpendicularly connected to one end of the common ground element and the other end of the first radiating element is open;

a first feeding element connected to the first radiating element for feeding electric current to the first radiating element;

a second radiating element for radiating a horizontally polarized wave of the predetermined band according to the ground condition of the antenna, wherein one end of the second radiating element is perpendicularly connected to the other end of the common ground element and the other end of the second radiating element is open; and a second feeding element connected to the second radiating element for feeding electric current to the second radiating element.

2. The internal diversity antenna as set forth in claim 1, wherein the first feeding element is vertically connected to the first radiating element.

3. The internal diversity antenna as set forth in claim 1, wherein the second feeding element is perpendicularly connected to the second radiating element.

4. The internal diversity antenna as set forth in claim 1, wherein the first or second radiating element is a wire radiating element.

5. The internal diversity antenna as set forth in claim 1, wherein the first or second radiating element is a planar radiating element.

6. The internal diversity antenna as set forth in claim 1, wherein the first feeding element and the second feeding element are arranged perpendicularly to each other.

7. An internal diversity antenna, comprising:

a first radiating element for radiating a vertically polarized wave of a predetermined band according to a ground condition of the antenna;

a first feeding element connected to the first radiating element for feeding electric current to the first radiating element;

a second radiating element for radiating a horizontally polarized wave of the predetermined band according to the ground condition of the antenna;

a second feeding element connected to the second radiating element for feeding electric current to the second radiating element; and a common ground element for forming a ground by electromagnetic coupling between the first radiating element and the second radiating element, and grounding the first and second radiating elements, wherein a part of the first radiating element is vertically separated from a part of the second radiating element by a predetermined distance, the parts of the first and second radiating elements overlapping each other, and the first or second radiating element is a planar radiating element.

8. The internal diversity antenna as set forth in claim 7, wherein the first feeding element is arranged parallel to the common ground element and connected to the first radiating element at a predetermined location adjacent the common ground element of the first radiating element, and the second feeding element is arranged perpendicularly to the common ground element and connected to the second radiating element at a predetermined location adjacent to the common ground element of the second radiating element.

9. An intenial diversity antenna, comprising:

a first radiating element for radiating a vertically polarized wave of a predetermined band according to a ground condition of the antenna;

a second radiating element connected to one end of the first radiating element for radiating a horizontally polarized wave of the predetermined band according to the ground condition of the antenna;

a first feeding element for feeding electric current to the first radiating element, wherein the first feeding element is connected to a connection part to which the first and second radiating elements are connected;

a second feeding element orthogonally connected to the first radiating element at the connection part for feeding electric current to the second radiating element; and a common ground element vertically connected to the first and second radiating elements at the connection part for grounding the antenna.

10. The internal diversity antenna as set forth in claim 9, wherein the first feeding element is connected in a lengthwise direction of the first radiating element at the connection part to which the first and second radiating elements are connected, and the second feeding element is connected in a lengthwise direction of the second radiating element at the connection part.

* * * * *